US009269309B2

(12) United States Patent
Kang et al.

(10) Patent No.: US 9,269,309 B2
(45) Date of Patent: Feb. 23, 2016

(54) DUAL MODULATION USING CONCURRENT PORTIONS OF LUMINANCE PATTERNS IN TEMPORAL FIELDS

(75) Inventors: Michael Kang, North Vancouver (CA); Louis D. Silverstein, Scottsdale, AZ (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 375 days.

(21) Appl. No.: 13/378,111

(22) PCT Filed: Jun. 29, 2010

(86) PCT No.: PCT/US2010/040366

§ 371 (c)(1),
(2), (4) Date: Dec. 14, 2011

(87) PCT Pub. No.: WO2011/002757

PCT Pub. Date: Jan. 6, 2011

(65) Prior Publication Data

US 2012/0092360 A1 Apr. 19, 2012

Related U.S. Application Data

(60) Provisional application No. 61/222,858, filed on Jul. 2, 2009.

(51) Int. Cl.

| | |
|---|---|
| ***G09G 5/02*** | (2006.01) |
| ***G09G 3/34*** | (2006.01) |
| ***G09G 3/36*** | (2006.01) |

(52) U.S. Cl.

CPC ..... *G09G 3/3426* (2013.01); *G09G 3/3413* (2013.01); *G09G 3/3607* (2013.01);

(Continued)

(58) Field of Classification Search

CPC ... G09G 5/02; G09G 5/06; G09G 2320/0666; G09G 2340/06; G06T 11/001

See application file for complete search history.

(56) References Cited

U.S. PATENT DOCUMENTS

| | | | |
|---|---|---|---|
| 6,753,936 | B2 | 6/2004 | Tanaka |
| 8,038,316 | B2 | 10/2011 | Silverstein |

(Continued)

FOREIGN PATENT DOCUMENTS

| | | |
|---|---|---|
| EP | 1715473 | 4/2006 |
| WO | 2006/066418 | 6/2006 |

(Continued)

OTHER PUBLICATIONS

Louis D. Silverstein Sander J. Roosendaal Martin J. J. Jak; "Hybrid spatial—temporal color synthesis and its applications"; Jan. 2006; vol. 14, Issue 1; 3-13.*

(Continued)

*Primary Examiner* — Peter Hoang

(57) ABSTRACT

Embodiments of the invention facilitate high-dynamic-range (HDR) imaging by generating portions of spatial and/or temporal luminance patterns with different spectral power distributions substantially concurrent with, for example, the modulation of the light intensity associated with the portions of luminance patterns. The method can include predicting luminance patterns associated with multiple spectral power distributions. The method also can include distributing portions of the luminance patterns in one or more temporal fields. In some embodiments, distributing the portions of the luminance patterns can include interlacing those portions. Further, the method can include modulating light intensities of the luminance patterns to produce an age with other spectral power distributions. In some embodiments, the distribution of the luminance pattern portions can be substantially synchronous with modulating the light intensity of the luminance patterns.

24 Claims, 9 Drawing Sheets

(52) U.S. Cl.
CPC .. *G09G2300/0452* (2013.01); *G09G 2310/024* (2013.01); *G09G 2310/0235* (2013.01); *G09G 2320/0247* (2013.01); *G09G 2320/0261* (2013.01); *G09G 2320/0646* (2013.01); *G09G 2360/16* (2013.01)

(56) References Cited

U.S. PATENT DOCUMENTS

| | | | |
|---|---|---|---|
| 2007/0070023 | A1 | 3/2007 | Yasuda |
| 2008/0238839 | A1 | 10/2008 | Kim |
| 2008/0259099 | A1 | 10/2008 | Arai |
| 2008/0266312 | A1 | 10/2008 | Chen |

FOREIGN PATENT DOCUMENTS

| | | |
|---|---|---|
| WO | 2006067750 | 6/2006 |
| WO | 2008100605 | 8/2008 |

OTHER PUBLICATIONS

Silverstein L.D., "STColor: Hybrid Spatial—Temporal Color Synthesis for Enhanced Display Image Quality" Jan. 1, 2005, SID, May 24-27, 2005, pp. 1112-1115.

Pierre De Greef, et al., "39.1: Adaptive Dimming and Boosting Backlight for LCD-TV Systems" 2007 SID International Symposium Society for Information Display, vol. XXXVIII, May 20, 2007, pp. 1332-1335.

* cited by examiner

| 2 SUB-PIXEL ELEMENT (e.g., Sub-Pixel 1/ Sub-Pixel 2) | Light Patterns (SPD 1 /SPD 2) | Output Pixel (SPD 1 /SPD 2) |
|---|---|---|
| CYAN/MAGENTA | BLUE/YELLOW | BLUE/(RED+GREEN) |
| GREEN/MAGENTA | CYAN/YELLOW | (GREEN+BLUE)/ (GREEN+RED) |
| CYAN/YELLOW | GREEN/MAGENTA | GREEN/(RED+BLUE) |
| BLUE/YELLOW | CYAN/MAGENTA | (BLUE+GREEN)/ (BLUE+RED) |
| MAGENTA/YELLOW | RED/CYAN | RED/(BLUE+GREEN) |
| RED/CYAN | MAGENTA/YELLOW | (RED+BLUE)/ (RED+GREEN) |

FIG. 8

DUAL MODULATION USING CONCURRENT PORTIONS OF LUMINANCE PATTERNS IN TEMPORAL FIELDS

CROSS-REFERENCE TO RELATED APPLICATIONS

This application claims priority to U.S. Patent Provisional Application No. 61/222,858, filed 2 Jul. 2009, hereby incorporated by reference in its entirety.

FIELD

Embodiments of the invention relate generally to generating images with an enhanced range of brightness levels, and more particularly, to systems, apparatuses, integrated circuits, computer-readable media, and methods to facilitate high dynamic range imaging by generating portions of luminance patterns with different spectral power distributions substantially concurrent with, for example, the modification of the light from the portions of luminance patterns using, for example, two sub-pixel mosaics.

BACKGROUND

High dynamic range ("HDR") imaging technology is implemented in projection and display devices to render imagery with a relatively wide range of luminance levels, where the range usually covers five orders of magnitude between the lowest and the highest luminance levels, with the variance in backlight luminance typically being more than, for example, about 5%, regardless of whether the overall luminance of the display is not relatively high. In some approaches, HDR image rendering devices employ a backlight unit to generate a low-resolution image that illuminates a display that provides variable transmissive structures for the pixels. An example of an HDR image rendering device is a display device that uses a multitude of monochromatic light emitting diodes ("LEDs") (e.g., white-colored LEDs) as backlight elements and a liquid crystal display ("LCD") for presenting a high-resolution image, illuminated by the LEDs.

While functional, various approaches have drawbacks in their implementation. In some approaches, LCDs, such as active-matrix LCDs ("AMLCDs"), can include a transistor and/or a capacitor for each sub-pixel, which can hinder transmission efficiencies of passing light through traditional pixels, which usually have three filtered sub-pixel elements corresponding to a set of color primaries, such as red ("R"), green ("G") and blue ("B"). Generally, the method of synthesizing a full-color image is known as spatial color synthesis. In some other approaches which utilize temporal color synthesis, fields of different colors are displayed in sequence (e.g., R, G and B) by transitioning through different backlight elements having different color outputs. Typically, this produces luminance variations from field to field that may be perceptible as flicker. A relatively more difficult problem arising from temporal color synthesis results from relative movement between the displayed image and the viewer's retina, whether the motion arises from the image or from the viewer's head and eye movements. In either case, the time-varying color components are no longer imaged on the same retinal region and the observer experiences what has come to be known as "color break-up," or "the rainbow effect." In at least one approach, a black frame may be inserted to reduce motion blur. However, the inserted black frame reduces the light throughput efficiency of the display and may also cause increased flicker due to the introduction of relatively large temporal luminance differences. Further, optical response times of LCD pixels to change from one luminance value to another may differ depending on the applied voltage range (or corresponding digital data values) across which the LCD pixel is transitioning. Typically, an LCD pixel can have a pixel value from 0 (e.g., no intensity) to 255 (e.g., full intensity), or, in some cases, pixel values may range from 0 to 1024. In some cases, for example, the optical response time of an LCD pixel may be quite different when changing between pixel values in the range of 0 to 255 than when changing between pixel values in the range of 128 to 200. Thus, a slow optical response time for some pixels can affect the rate at which other pixel values and/or intensities can be modified.

In view of the foregoing limitations of the existing approaches, it would be desirable to provide systems, computer-readable media, methods, integrated circuits, and apparatuses to facilitate high dynamic range imaging, among other things.

SUMMARY

Embodiments of the invention facilitate high-dynamic-range (HDR) imaging by generating portions of spatial and/or temporal luminance patterns with different spectral power distributions substantially concurrent with, for example, the modulation of the light intensity associated with the portions of luminance patterns. The method can include predicting luminance patterns associated with multiple spectral power distributions. The method also can include distributing portions of the luminance patterns in one or more temporal fields. In some embodiments, distributing the portions of the luminance patterns can include interlacing those portions. Further, the method can include modulating the light intensity of the luminance patterns to produce an image with other spectral power distributions. In some embodiments, the distribution of the luminance pattern portions can be substantially synchronous with modulating the light intensity of the luminance patterns.

BRIEF DESCRIPTION OF THE FIGURES

The invention and its various embodiments are more fully appreciated in connection with the following detailed description taken in conjunction with the accompanying drawings, in which:

FIG. 8 illustrates examples of synthesizing colors based on two sub-pixel color elements and two luminance patterns, according to at least some embodiments of the invention.

Like reference numerals refer to corresponding parts throughout the several views of the drawings. Note that most of the reference numerals include one or two left-most digits that generally identify the figure that first introduces that reference number.

DETAILED DESCRIPTION

Figure 1A:
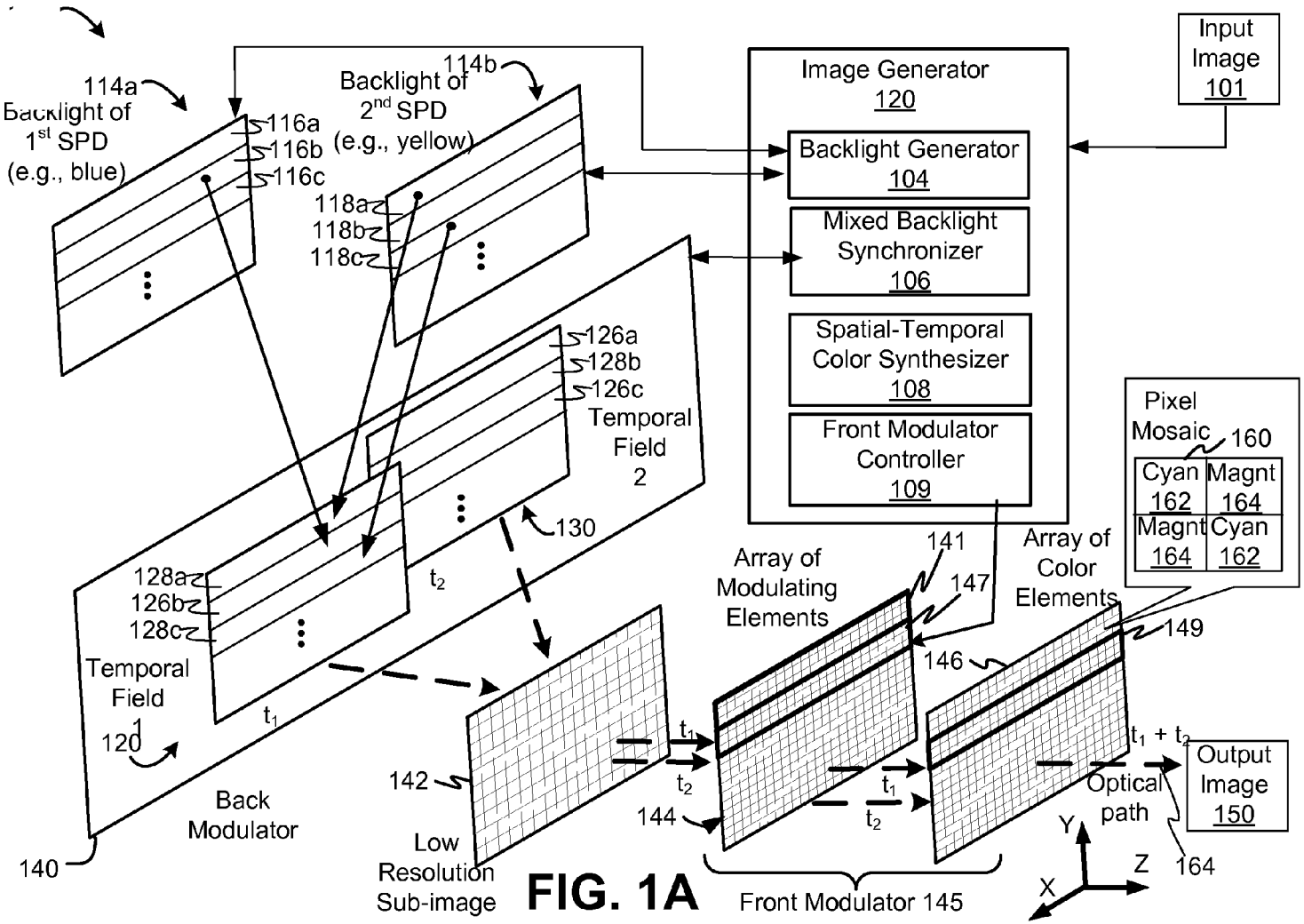
FIG. 1A is a diagram illustrating an example of an image generation apparatus including dual modulators configured to distribute portions of luminance patterns in temporal fields, according to at least some embodiments of the invention.

FIG. 1A is a diagram illustrating an example of an image generation apparatus including dual modulators configured to distribute portions of luminance patterns in temporal fields, according to at least some embodiments of the invention. Apparatus 100 can include an image generator 120, a back modulator 140, and a front modulator 145. Image generator 120 receives an input image 101 and controls both back modulator 140 and front modulator 145 to generate an image such as an output image 150. The output image can be an enhanced range of brightness levels (e.g., with levels associated with high dynamic ranges, or HDRs, of luminance). Back modulator 140 includes light sources that can generate multiple spectral power distributions. In some examples, image generator 120 generates a luminance pattern 114*a* based on data representing a backlight for first spectral power distribution (e.g., relating to blue), and generates a luminance pattern 114*b* based on data representing a backlight for a second spectral power distribution (e.g., relating to yellow, which is the combination of green and red). Image generator 120 can be configured to distribute portions 116*a* to 116*c* of luminance pattern 114*a* and portions 118*a* to 118*c* of luminance pattern 114*b* in one or more temporal fields. As shown, one or more portions 118*a* to 118*c* of luminance pattern 114*b* are distributed with one or more portions 116*a* to 116*c* of luminance pattern 114*a* in a temporal field 120 associated with a time interval, t1. Similarly, one or more portions 118*a* to 118*c* and one or more portions 116*a* to 116*c* are distributed in a temporal field 130 associated with another time interval, t2, which can follow the time interval t1. Further, image generator 120 controls front modulator 145 to modify luminance pattern 114*a* of the first spectral power distribution and luminance pattern 114*b* of the second spectral power distribution, thereby producing output image 150 with other spectral power distributions. In at least one embodiment, image generator 120 can distribute of portions of luminance pattern 114*a* and luminance pattern 114*b* in a temporal field, followed by modulation of light intensities of the luminance values of portions of luminance pattern 114*a* and luminance pattern 114*b* to produce an image with other spectral power distributions. For example, the other spectral power distributions are generated by using color elements arranged in (e.g., a two sub-pixel mosaic) to modulate light intensities of the first and second spectral power distributions to generate a first modified spectral power distribution and a second modified spectral power distribution. As used herein, the term "modified spectral power distribution" can refer, at least in some embodiments, to the spectral power distribution of light emerging from one or more color elements, where the spectral power distribution of a light source, such as backlight, interacts with the transmittance of the color elements to produce light in the primary colors.

In view of the foregoing, image generator 120 and at least some of its constituents can operate to synthesize color using, for example, two temporal fields and/or two sub-pixels color elements. In some examples, using two temporal fields, such as temporal field 120 and temporal field 130, reduces the rate at which temporal fields are transitioned, thereby reducing the frequency of luminance variations (e.g., over the surface of an array of color elements 146 or during a point in time), relative to implementations that use three temporal fields (e.g., a red temporal field, a green temporal field, and a blue temporal field). Thus, apparatus 100 can mitigate or eliminate a degree of flicker and/or color breakup that otherwise might be present, for example, with three temporal fields transitioning among each other. In one or more embodiments, the luminance difference between luminance pattern 114*a* of the first spectral power distribution and luminance pattern 114*b* of the second spectral power distribution can be reduced. For example, the first spectral power distribution and the second spectral power distribution can be associated with respective colors of blue and yellow (e.g., a combination of red and green), cyan and yellow, or other combinations of spectral power distributions, some of which are depicted in the Light Patterns column of FIG. 8. In at least some embodiments, the portions from luminance pattern 114*a* and 114*b* are distributed in sequence (or substantially in sequence) within temporal fields 120 and 130. For example, different portions of luminance pattern 114*a* and 114*b* are distributed in either temporal field 120 or temporal field 130. In some embodiments, the portions from luminance pattern 114*a* and 114*b* are distributed in sequence after some amount of time, thereby spreading luminance differences between temporal field 120 and 130 at different points of time over the duration of both temporal field 120 and 130, rather than having luminance differences occurring simultaneously at, for example, the transitioning of temporal fields at one point in time (during two temporal fields). In at least some embodiments, the portions from luminance pattern 114*a* and 114*b* are distributed in sequence, each portion being distributed in synchronization with, for example, the activation of a group of modulation elements in an array of modulation elements 144.

As used herein, the term "activation" can refer to, at least in some embodiments, to an event that updates one or more modulation elements to scale luminance values. For example, a modulation element can be activated to update or modify its transmissity (i.e., its transmission value). In one or more embodiments, modulation elements 144 are liquid crystal display ("LCD") devices, such as active matrix LCD ("AM-LCD") devices, which can be refreshed in groups of LCD devices. In some embodiments, a spectral power distribution for luminance pattern 114*a* or 114*b* is blue, which can have an luminance value that can be used to emulate an insertion of a black frame to reduce motion blur, without the luminance differences between, for example, white (or yellow) and black that may contribute to flicker. In some embodiments, luminance differences between color channels to emulate black frame insertion are modified locally (e.g., by interlacing portions of luminance patterns), thereby reducing luminance differences that might otherwise generate perceptible flicker globally over successive entire temporal fields. Note that in various other embodiments, spectral power distributions for luminance pattern 114*a* and 114*b* can be any spectral power distribution, examples of which are set forth in FIG. 8 under heading "Light Patterns (SPD1/SPD2)". For example, spectral power distributions for luminance pattern 114*a* and 114*b* can correspond to cyan and red, with luminance differences being less than between black and white (or yellow). Thus, cyan and red are used to approximate an insertion of a black frame, too. Further, a reduction in the quantity of sub-pixels from three sub-pixels (e.g., one sub-pixel for each of red, green and blue) to two (e.g., one sub-pixel for each of magenta and green) may require fewer components (e.g., such as two drivers rather than three) used to control each pixel. For example, a liquid crystal display front modulator having 1920×1080×2 sub-pixels may require less drive electronics for a two sub-pixel element rather than for a three sub-pixel element (i.e., 1920×1080×3 pixels). In addition, because of an increased fill factor (e.g., percentage of imaging surface that passes light) on a modulator with 2 sub-pixels rather than 3 sub-pixels, modulator transmission efficiency can also be improved.

Image generator 120 can include a backlight generator 104, a mixed backlight synchronizer 106, a spatial-temporal color synthesizer 108, and a front modulator controller 109. Backlight generator 104 generates (and/or stores) data representing one or more models of backlight at resolutions that are lower than the number of pixels (or sub-pixels) associated with front modulator 145. In at least some embodiments, backlight generator 104 generates data representing a model of backlight associated with the first spectral power distribution (e.g., blue), and generates data representing another model of backlight associated with the second spectral power distribution (e.g., yellow). Backlight generator 104 can generate data that represents any model of backlight for any subsets of the first or the second spectral power distributions. For example, backlight generator 104 can generate data representing a model of backlight for blue-colored luminance patterns, a model of backlight for red-colored luminance patterns, and a model of backlight for green-colored luminance patterns, where the models of backlight for the latter two luminance patterns (e.g., the red and green luminance patterns) are used together to form the second spectral power distribution (e.g., yellow).

In some embodiments, backlight generator 104 generates a model of backlight by determining a target backlight for a spectral power distribution using input image 101, the target backlight being, for example, a downsampled or lower resolution version of input image 101. Backlight generator 104 then can derive the intensities (or luminance values), and, thus, the drive values to be applied to each of the light sources in an array of light sources, such as in an array of light sources for generating a blue color of light. For the derived drive values, a point spread function or a Gaussian-like filter can be applied to the luminance values of the target backlight to determine an aggregated value, which can be referred to as "simulated backlight." As used herein, the term "luminance pattern" can refer, at least in some embodiments, to a pattern of light having various values of luminance or intensity for a spectral power distribution that includes color (e.g., red, green, blue, cyan, yellow, etc). Thus, a luminance pattern also can refer to a low resolution image of input image 101 for a specific color, and, as such, a luminance pattern can be associated with either a target backlight or a simulated backlight. In some embodiments, the term "predicted luminance pattern" can refer to a pattern of light generated in accordance with data representing a model of backlight (e.g., simulated backlight). In at least one embodiment, the term "luminance pattern" can be used interchangeably with the term "backlight." Therefore, backlight generator 104 can generate luminance patterns 114*a* and 114*b*.

Mixed backlight synchronizer 106 distributes the portions of luminance patterns 114*a* and 114*b* between temporal frames 120 and 130. For example, mixed backlight synchronizer 106 can be configured to cause back modulator 140 transition from generating one portion of luminance pattern 114*a* to generating one portion of luminance pattern 114*b*, both portions being distributed (e.g., sequentially) into temporal field 120. While FIG. 1A depicts portions luminance of patterns 114*a* and 114*b* distributed sequentially, various embodiments can distribute them in any other way (e.g., spatially) in a temporal field (e.g., temporal field 120). Further, mixed backlight synchronizer 106 can synchronize the transition, for example, from generating portion 128*a* to portion 126*b* to the application of light to a group of color elements 149, which can be used to generate a modified spectral power distribution.

In some embodiments, mixed backlight synchronizer 106 interlaces portions of luminance patterns 114*a* and 114*b* in one or more temporal fields. Thus, mixed backlight synchronizer 106 can control modulation of any number of sets of light sources in back modulator 140 to generate portions of luminance patterns 114*a* and 114*b* in synchronicity with an interval of time. In some examples, the interval of time coincides with an interval of time during which a group of modulating elements 147 can be activated (e.g., updated). For example, mixed backlight synchronizer 106 can be configured to select portion 118*a* and arrange it as interlaced portion 128*a* in temporal field 120, after which back modulator 140 can generate interlaced portion 128*a*. Further, mixed backlight synchronizer 106 selects portion 116*b* and portion 118*c* and arranges them as interlaced portion 126*b* and interlaced portion 128*c*, respectively, in temporal field 120, after which back modulator 140 generates interlaced portions 126*b* and 128*c*. Similarly, mixed backlight synchronizer 106 can interlace (or interleave) portions 116*a*, 118*b*, and 116*c* to form interlaced portions 126*a*, 128*b*, and 126*c*, respectively, in temporal field 130. Note that mixed backlight synchronizer 106 can temporally overlap interlaced portions 128*a*, 126*b*, and 128*c* onto interlaced portions 126*a*, 128*b*, and 126*c*, respectively, during one temporal frame that spans temporal field 120 and temporal field 130.

Back modulator 140 can be configured to generate temporal field 120 (or its portions) prior to generating temporal field 130 (or its portions) and transmit the portions of luminance patterns 114*a* and 114*b* via optical path 164 to thereby form a low resolution sub-image 142. In some embodiments, temporal field 120 need not be transmitted completely via optical path 164 before a portion of temporal field 130 is transmitted. Thus, portions of temporal field 120 and temporal field 130 are distributed successively (i.e., serially), and are transmitted alternately in groups of one or more portions of temporal field 120 and temporal field 130 via optical path 164. In some embodiments, at least one portion from either temporal field 120 or temporal field 130 is generated or transmitted parallel to the other temporal field. In other embodiments, the interlace portions of temporal fields 120 and 130 need not be rectangular in shape, but can by any shape, such as block-shaped. Further, the interlace portions of temporal fields 120 and 130 need not be linearly distributed (e.g., from top to bottom) in temporal fields 120 and 130. For example, the interlace portions can be scattered or can be arbitrarily distributed. In some embodiments, the ordering of the distribution of interlace portions into temporal fields 120 and 130 can be based on and/or size to accommodate, for example, a quantity of pixels undergoing luminance differences above a threshold amount, for example. The light sources of back modulator 140 can be composed of light emitted diodes ("LEDs") configured to generate colored light, such as red LEDs, blue LEDs, and green LEDs. Other examples of light sources of back modulator 140 include, but are not limited to, a two spectrum backlight including cold cathode fluorescent ("CCF") tubes that generate, for example, cyan and yellow light, or any other light modulators. In some embodiments, light sources can be reflective and can be considered sources of light. Examples of these types of light sources include liquid crystal on silicon ("LCoS") modulating devices, digital micro-mirror device-based ("DMD") modulators and other implementations that can reflect light from a lamp or illumination device.

Front modulator controller 109 is configured to control front modulator 145, which includes an array of modulating elements 144 and an array of color filter elements 146, whereby a color element 146 corresponds to a respective modulating element 144 to collaborate in modulating light intensities of the first spectral power distribution or the second spectral power distribution (e.g., to modify color and/or luminance). In some embodiments, a collection of color elements 162 and 164 constitute a pixel mosaic 160, which, in turn, correspond to a pixel composed of modulating elements 144. In this example, pixel mosaic 160 includes cyan color filter elements 162 configured to produce or pass green and blue color light, and magenta ("magnt") color filter elements 164 configured to produce or pass red and blue color light, both cyan color elements 162 and magenta color elements 164 being responsive to either a luminance pattern of the first spectral power distribution or another luminance pattern of the second spectral power distribution to generate other spectral power distributions (e.g., colored light that is different than that of the first spectral power distribution or the second spectral power distribution). Thus, output image 150 can be produced with colored light that includes full color (e.g., based on three primary colors).

As used herein, the term "sub-pixel" can refer, at least in some embodiments, to a combined structure and/or functionality composed of (or associated with) one of color elements 162 and 164 and a modulating element 144. A sub-pixel can be an individually-addressable modulating element that can correspond to a color element. In some embodiments, a sub-pixel can refer to the smallest unit of information in an image for which an associated intensity can be modulated. In at least some embodiments, a group of modulating elements (e.g., a group of sub-pixels) can correspond with a group of color elements, the combined functionality of which can provide for a pixel that can provide full color (e.g., a pixel can be configured to provide for the spatial combination of colors produced by sub-pixels in the X and Y plane to produce colors based on the primary colors).

As used herein, the term "pixel" can refer, at least in some embodiments, to a combined structure and/or functionality composed of (or associated with) a pixel mosaic 160 and a collection of modulating elements 144. In some embodiments, array of modulating elements 144 can be an array of liquid crystal display ("LCDs") devices, such as active matrix LCD devices. A "pixel" can be a portion of an image, and can include a group of sub-pixels, each of which can constitute a part or portion of the image. For example, a pixel can include sub-pixels, with sub-pixels 162 being configured to include green ("G") color elements (or color filters) and sub-pixels 164 being configured to include magenta ("M") color elements. As used herein, the term "modulating element" can correspond to, at least in some embodiments, either an individually-addressable sub-pixel or an individually-addressable pixel, and, in some cases, the term "sub-pixel" can be used interchangeably with the term "pixel." For example, there can be instances in which the term "pixel" can be used to describe a smallest unit of information (rather than the sub-pixel) for which an associated intensity can be modulated. As used herein, the term "pixel mosaic" can refer to, at least in some embodiments, a group of color filters that can correspond to a group of modulating elements. For example, a pixel mosaic of color filters can correspond to sub-pixels that constitute a pixel. In some embodiments, the positions of components 141 and 146 can be interchanged such that color elements in components 146 can receive backlight and transmit light to modulating elements in component 141, which, in turn, generates output image 150.

Front modulator controller 109 is configured to activate (e.g., update) a group 147 of modulating elements 144 to, for example, modulate the intensity of a light from the first spectral power distribution or the second spectral power distribution, and/or to filter the color of the light by using color elements 162 and 164. In at least some embodiments, front modulator controller 109 activates successive groups 141 and 147 in the array of modulating elements 144, each of successive groups 141 and 147 being activated during an interval of time, which can correspond to back modulator 140 generating (e.g., transitioning to) an interlace portion of luminance patterns 114*a* or 114*b*. Thus, the activation of group 147 can be synchronized with the generation of interlaced portion 126*b*. Further, the modulation of light intensities associated with the first spectral power distribution or the second spectral power distribution by group 149 of color elements also can coincide with (or substantially coincide with) the interval of time to which activation of group 147 and interlaced portion 126*b* are synchronized (or substantially synchronized).

Front modulator controller 109 also generates drive signals for groups 141 and 147 of modulating elements 144, according to at least some embodiments. For example, front modulator controller 109 can drive groups 141 and 147 of modulating elements 144 with drive signals that are based on multiple luminance patterns, such as luminance patterns 114*a* and 114*b*, during a single temporal field. Thus, the drive signals are configured to activate group 147 or group 141 of modulating elements 144 to modify luminance values of the luminance patterns. In some instances, drive signals are generated to successively activate groups 141 and 147 to, for example, alternate the modulation of the light from luminance pattern 114*b* and the light of luminance pattern 114*b*, respectively. The rate at which a portion of a first luminance pattern and a portion of a second luminance pattern alternate can be the same (or substantially the same) as the rate at which successive groups 141 and 147 are activated.

Spatial-temporal color synthesizer 108 can be configured to manage color synthesis for image generator 120 using one or more of the following color synthesis techniques. In at least some embodiments, spatial-temporal color synthesizer 108 operates to manage spatial temporal color synthesis in the Z-direction (e.g., along optical path 164), which synthesizes color using, for example, two backlights to produce two luminance patterns 114*a* and 114*b*. In at least some embodiments, spatial-temporal color synthesizer 108 is configured to manage three-dimensional ("3D") color synthesis (e.g., along optical path 164 as well as in the image plane in the X and Y directions), which produces full color images (e.g., in wavelengths of visible light) using pixel mosaics 160, such as a two sub-pixel mosaic, in combination with the backlights. Spatial-temporal color synthesizer 108 also operates to ensure that the colors of input image 101 are generated for output image 150 by managing image controller 120 (or its other elements) to use interlaced portions of temporal fields 120 and 130 in combination with color elements 162 and 164 to generate visible light for output image 150. For example, consider that back modulator 140 includes arrays of red, green and blue LEDs that can be individually (e.g., locally)

controllable. Also consider that color elements 162 and 164 are cyan and magenta filters, respectively. When back modulator 140 produces blue light, the cyan and magenta color elements 162 and 164 pass blue light and control the color blue. When back modulator 140 produces red light, the magenta color elements 164 passes red and can be used to control that the color red. When back modulator 140 produces green light, the cyan color elements 162 passes green and can be used to control that the color green. In the example shown, spatial-temporal color synthesizer 108 manages the two temporal fields that include alternating bands of blue and red/green backlight areas (i.e., luminance patterns). In some embodiments, spatial-temporal color synthesizer 108 generates output pixels having colors in the Output Pixel column of FIG. 8 by ensuring that front modulator controller 109 controls the 2 sub-pixel elements of cyan and magenta in combination with blue and yellow Light Patterns.

Figure 1B:
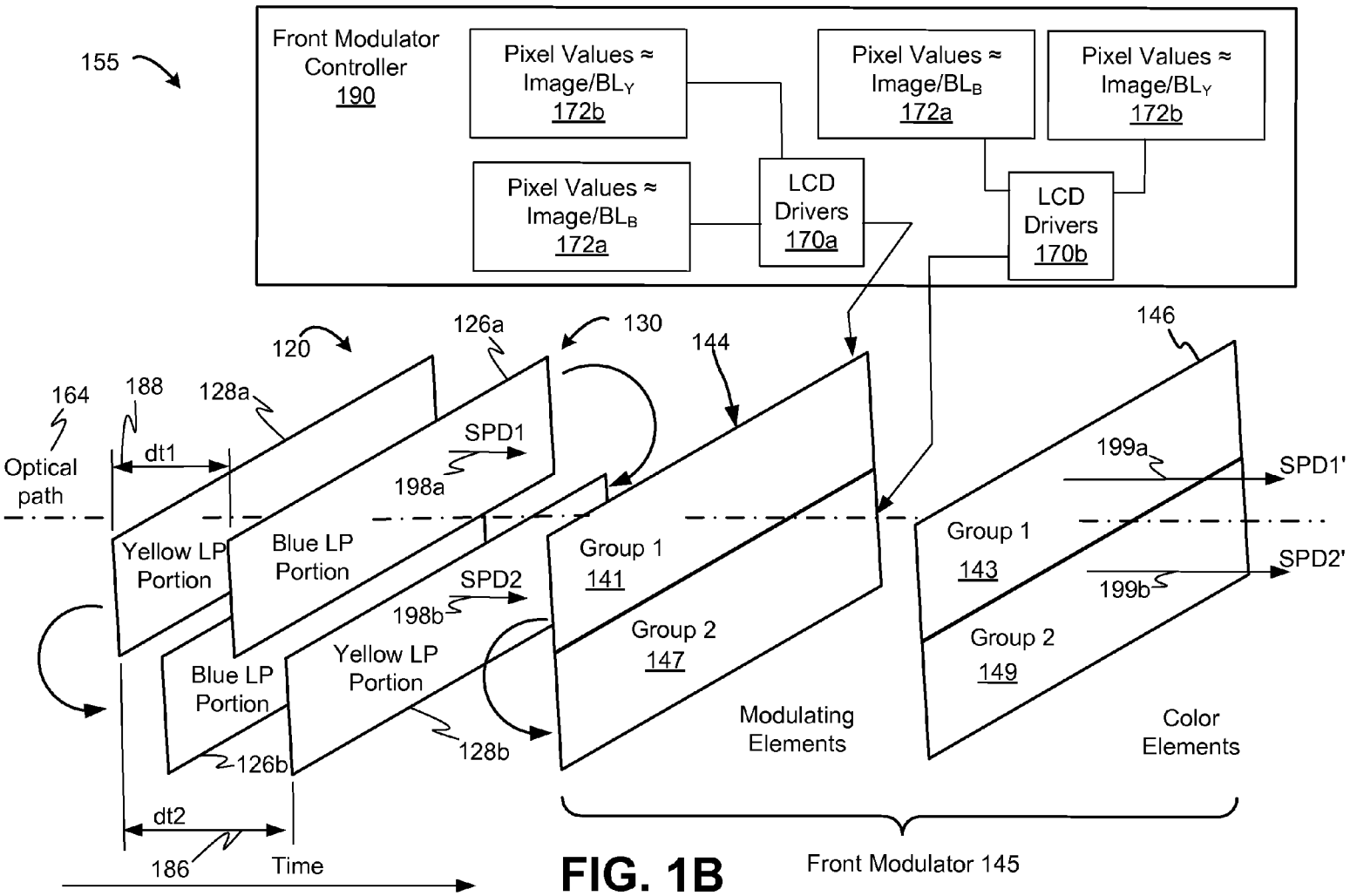
FIG. 1B is a diagram illustrating an example of a front modulator controller configured to generate drive signals based on multiple luminance patterns, according to at least some embodiments of the invention.

FIG. 1B is a diagram illustrating an example of a front modulator controller configured to generate drive signals based on multiple luminance patterns, according to at least some embodiments of the invention. Diagram 155 depicts a front modulator controller 190 coupled to groups 141 and 147 of modulating elements 144 of FIG. 1A. Front modulator controller 190 includes LCD drivers 170*a* and LCD drivers 170*b*, each of which is coupled to a pixel value calculator. Pixel calculators 172*a* can be configured to generate pixel values as a function of data representing input image 101 divided by the luminance values of luminance pattern 114*a* (e.g., blue backlight, or "$BL_B$"). Pixel calculators 172*b* also can be configured to generate pixel values as a function of data representing input image 101 divided by the luminance values of luminance pattern 114*b* (e.g., yellow backlight, or "$BL_Y$"). Further, diagram 155 depicts groups 143 and 149 of color elements 146 of FIG. 1A. In some embodiments, pixel calculators 172*a* and 172*b* need not be limited to division when generating pixel values. In some embodiments, pixel calculator includes logic (e.g., hardware and/or software) to generate pixel values to drive the array of red lights separate from the array of green light. In this case, the pixel values are a function of data representing input image 101 divided by the luminance values of luminance pattern of red light, and the data representing input image 101 divided by the luminance values of luminance pattern of green light.

To illustrate operation of front modulator controller 190, consider that front modulator controller 190 is configured to activate group ("group 1") 141 to operate on light from interlaced portion 128*a*, which is a portion of a yellow-colored luminance pattern ("LP"). Back modulator 140 generates interlaced portion 128*a* concurrent with the activation of group 141. Further, LCD drivers 170*a* receive pixel values from calculator 172*b* to generate drive signals (based on yellow-colored luminance patterns) to activate group 141. Front modulator controller 190 then can activate group ("group 2") 147 to operate on light from interlaced portion 126*b*, which is a portion of a blue-colored luminance pattern. In this case, LCD drivers 170*b* receive pixel values from calculator 172*a* to generate drive signals (based on blue-colored luminance patterns) to activate group 147. Back modulator 140 generates interlaced portion 126*b* concurrent with the activation of group 147. In view of the foregoing, LCD drivers 170*a* and 170*b* can receive pixel values based on different luminance patterns in a temporal field to drive modulating elements 144. Front modulator controller 190 can operate similarly with respect to interlace portions 126*a* and 128*b*.

In the example shown, interlace portion 126*a* is spatially aligned along optical path 164 with group ("1") 141 of modulating elements (e.g., LCDs) and with a group ("1") 143 of color elements, whereas interlace portion 128*a* is spatially aligned along optical path 164 with group ("2") 147 of modulating elements (e.g., LCDs) and with a group ("2") 149 of color elements. Interlace portion 126*a* includes a luminance pattern portion (e.g., Blue LP Portion) based on a first spectral power density ("SPD1") 198*a*, and interlace portion 128*b* includes a luminance pattern portion (e.g., Yellow LP Portion) based on a second spectral power density ("SPD2") 198*b*. LCD Drivers 170*a* and 170*b* can be configured to modify the luminance values of the luminance pattern portions associated with interlace portions 126*a* and 128*b* substantially in one temporal field. A group ("1") 143 of color elements 146 generate a first modified spectral power density ("SPD1'") and a group ("2") 149 of color elements 146 generate a second modified spectral power density ("SPD2'"). In some embodiments, color elements 146 are color filters that have particular transmittances that are configured to modify spectral power densities 198*a* and 198*b* to generate modified spectral power densities 199*a* and 199*b*.

FIG. 1B also depicts that successive interlace portions 126*a* and 128*b* and successive interlace portions 128*a* and 126*b* can be distributed in sequence after some amount of time, according to some embodiments. Thus, the generation of luminance differences between temporal field 120 and 130 can be performed at different points of time over the duration of both temporal field 120 and 130, rather than having luminance differences occurring simultaneously at, for example, the transitioning of temporal fields at one point in time (during two temporal fields). To illustrate, consider that groups 141 and 147 include modulating elements 144, such as LCD devices, that can be refreshed after an amount of time. Thus, interlace portion 126*b* is generated after that amount of time after interlaced portion 128*a* during temporal field 120. In the next temporal field 130, luminance differences can arise. For example, the luminance difference between blue and yellow for interlace portions 126*a* and 128*a* can occur after delta time 1 ("dt1") 188, whereas the luminance difference between blue and yellow for interlace portions 128*b* and 126*b* can occur after delta time 2 ("dt2") 186, which is offset from delta time 188. Thus, the luminance differences can be spread over a temporal frame composed of temporal field 120 and temporal field 130, at least in some embodiments. By spreading luminance differences across the two temporal frames in this manner, and by interlacing the blue and yellow frames, the overall luminance difference of the image is minimal between temporal frames, leading to reduced perceived flicker.

Figure 2:
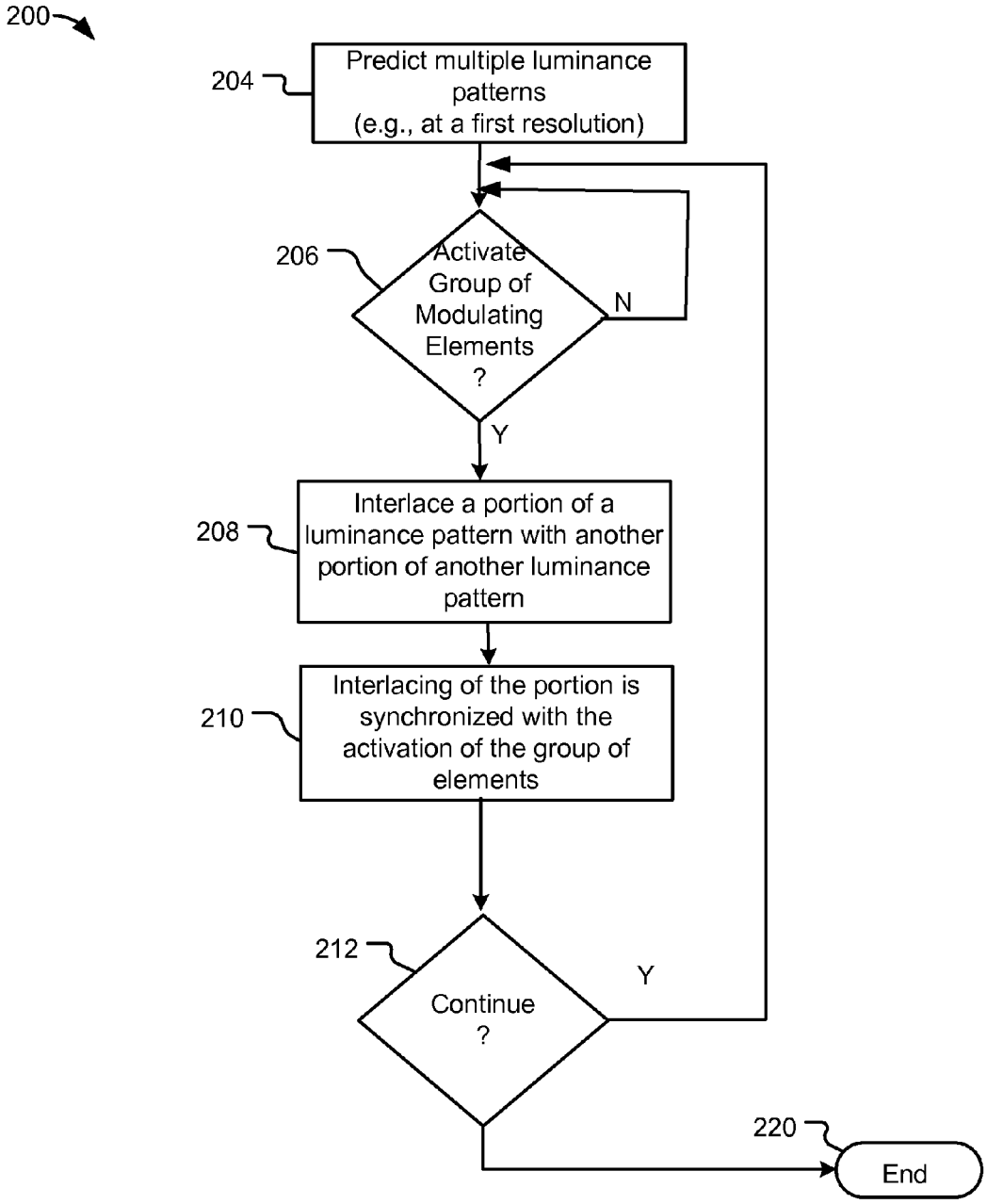
FIG. 2 is an example of a flow for a method of synchronizing the generation of alternating portions of different luminance patterns with groups of modulating elements, according to at least some embodiments of the invention.

FIG. 2 is an example of a flow 200 for a method of synchronizing the generation of alternating portions of different luminance patterns with groups of modulating elements, according to at least some embodiments of the invention. At 204, multiple luminance patterns can be predicted at a first resolution, which is less than a resolution associated with a front modulator. The multiple luminance patterns can be represented by data defining models of, for example, blue backlight and yellow backlight. At 206, a determination is made whether a group of modulating elements have been activated. If not, flow 200 repeats 206. Otherwise, flow 200 passes to 208, at which a portion of a luminance pattern is interlaced with another portion of another luminance pattern. At 210, the interlaced portion can be generated in synchronicity with the activation of the group of modulating elements. At 212, a determination is made whether to continue. If so, flow 200 goes back to 206. Otherwise, flow 200 terminates at 220.

Figure 3:
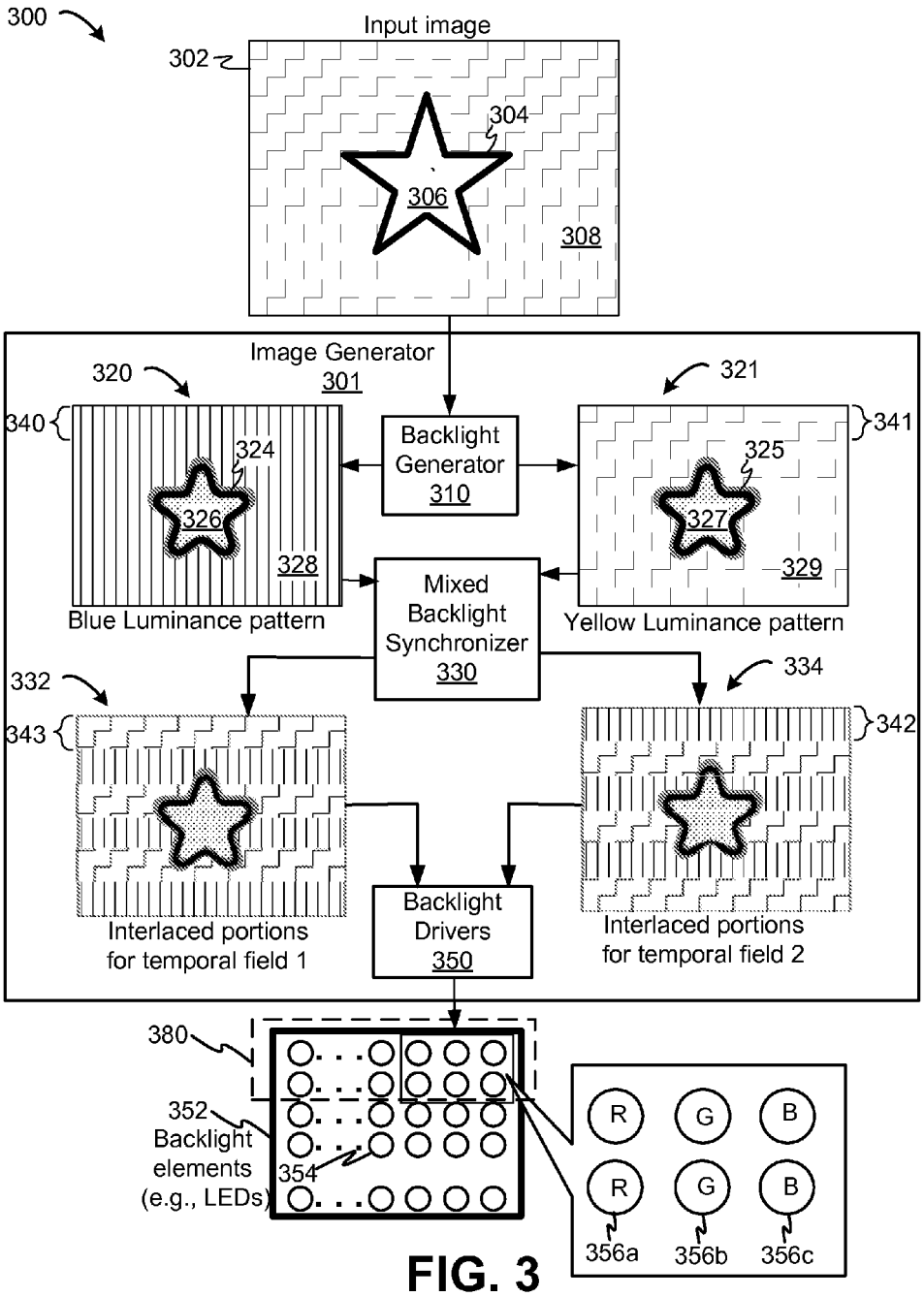
FIG. 3 is a functional diagram depicting an implementation of interlaced portions in multiple temporal fields, according to at least some embodiments of the invention.

FIG. 3 is a functional diagram depicting an implementation of interlaced portions in multiple temporal fields, according to at least some embodiments of the invention. Diagram 300 shows an input image 302 being applied to an image generator 301, which, in turn, is configured to operate an array 352 of backlight elements (i.e., light sources). Input image 302 is shown to include a star having a white portion 306 and a black outline portion 304 and a green background 308. Backlight generator 310 can be configured to generate a blue luminance pattern 320 and a yellow luminance pattern 321. Blue luminance pattern 320 includes a blurry image of the star at a low resolution, with black outline portion 304 being represented as blurry outline 324 at a low resolution. Blue luminance pattern 320 includes a blue portion 326, as the color blue is a component of white portion 306. But as background 308 is green, background 328 of blue luminance pattern 320 is approximately black, or very low intensity blue. Yellow luminance pattern 321 includes a blurry image of the star at a low resolution, with black outline portion 304 being represented as blurry outline 325 at a low resolution. Yellow luminance pattern 320 includes a yellow portion 327, as the color yellow is a component of white portion 306. As background 308 is green, background 329 of yellow luminance pattern 321 can be approximately yellow. Note that in some embodiments, the backlights elements are composed of blue and yellow-colored light sources. In other embodiments, backlight elements can include 3 types (e.g., red, green, and blue), as is discussed below. In this case, background 329 need not be limited to yellow, and can be green because red light sources may not be needed to produce a reproduction of background 308, which is green.

Next, a mixed backlight synchronizer 330 can be configured to distribute a portion 340 of blue luminance pattern 320 into temporal field ("2") 334 to form interlaced portion 342, and to distribute portion 341 of yellow luminance pattern 321 into temporal field ("1") 332 to form interlace portion 343. Mixed backlight synchronizer 330 continues to interlace portions of blue luminance pattern 320 and portions of yellow luminance pattern 321 between temporal fields 332 and 334. Backlight drivers 350 can be configured to drive arrays of backlight elements 354, the arrays including arrays of red light sources ("R") 356*a*, green light sources ("G") 356*b*, and blue light sources ("B") 356*c* (note that the sizes of the light sources are not to scale). In one example, image generator 301 can be configured to drive red and green light sources in a group 380 of lights sources to generate interlaced portion 343, which originates from yellow luminance pattern 321.

Figure 4:
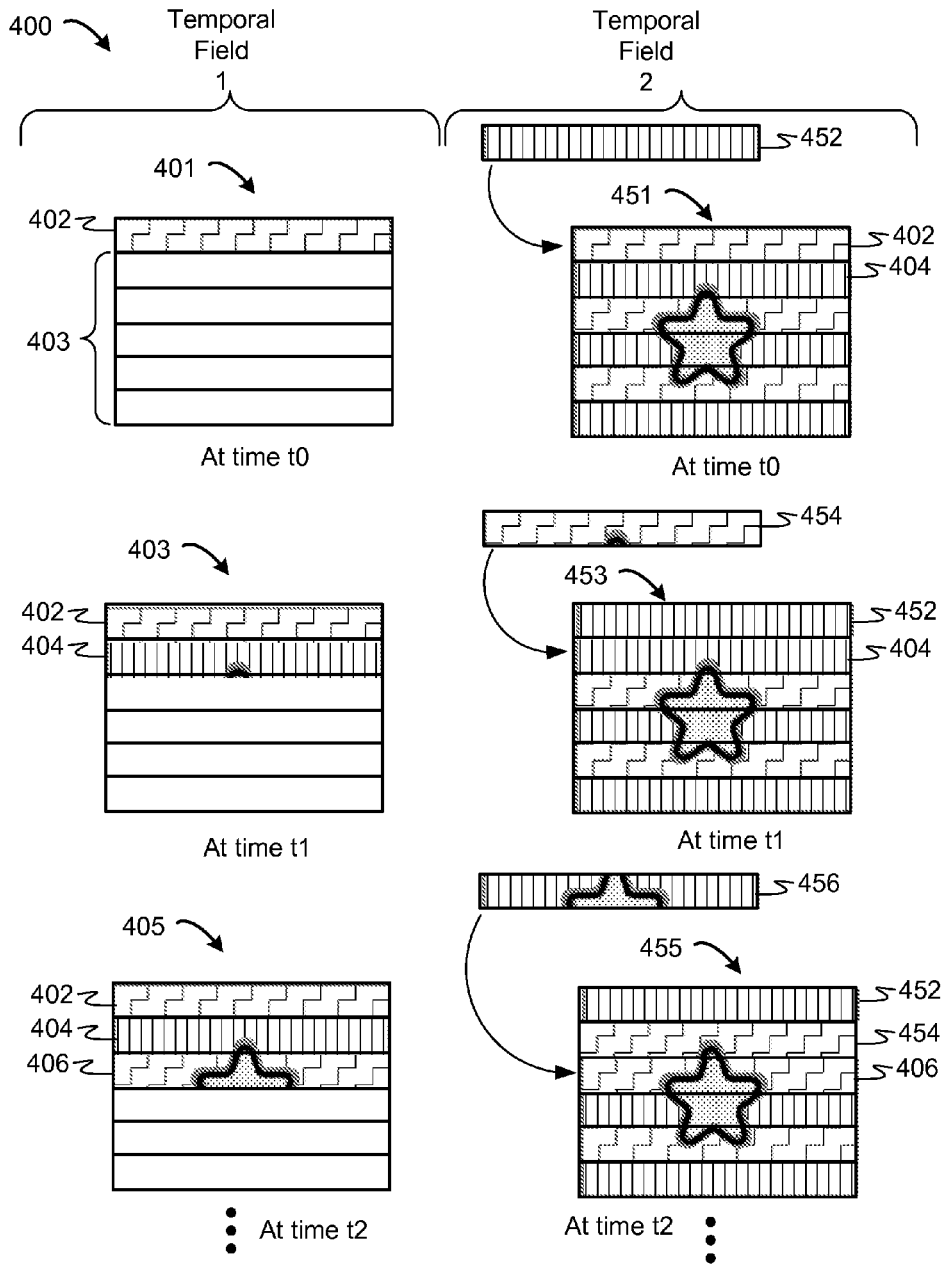
FIG. 4 illustrates distribution of portions of luminance patterns, according to at least some embodiments of the invention.

FIG. 4 illustrates distribution of portions of luminance patterns, according to at least some embodiments of the invention. Diagram 400 depicts distribution of portions of luminance patterns over two temporal fields. At time t0 of temporal field 1, an arrangement 401 of interlace portions includes an interlace portion 402, whereas other portions 403 can be from a previous temporal frame or field. At time t1 of temporal field 1, an arrangement 401 includes interlace portion 402 and interlaced portion 404, both of which can be formed in sequence. Next, at time t2 of temporal field 1, an arrangement 405 includes interlaced portions 402, 404 and 406, which are respectively derived from yellow luminance pattern 321 of FIG. 3, blue luminance pattern 320, and yellow luminance pattern 321. Portions of different luminance patterns can continue to be interlaced with each other for the remainder of temporal field 1. Next, at time t0 of temporal field 2, an arrangement 451 of interlace portions includes an interlace portion 402 and interlace portion 404, as well as other portions from temporal field 1. Here, portion 451 is distributed into temporal field 2 to replace portion 402. At time t1 of temporal field 2, an arrangement 453 includes interlace portion 452 and interlaced portion 404, which is replaced by portion 454. Next, at time t2 of temporal field 2, an arrangement 455 includes interlaced portions 452, 454 and 406, which is replaced by portion 456. Interlace portions 452 and 456 can originate from blue luminance pattern 320 of FIG. 3, whereas interlace portion 454 can originate from yellow luminance pattern 321. Portions of different luminance patterns can continue to be interlaced with each other for the remainder of temporal field 2. Note that in other embodiments, more or fewer temporal fields can be implemented. In other embodiments, distribution of portions of luminance patterns need not be successive, and/or can be distributed in any manner. According to various embodiments, the shapes of the portions of the different luminance patterns can be of any shape, and need not be limited to a rectangular shape.

Figure 5:
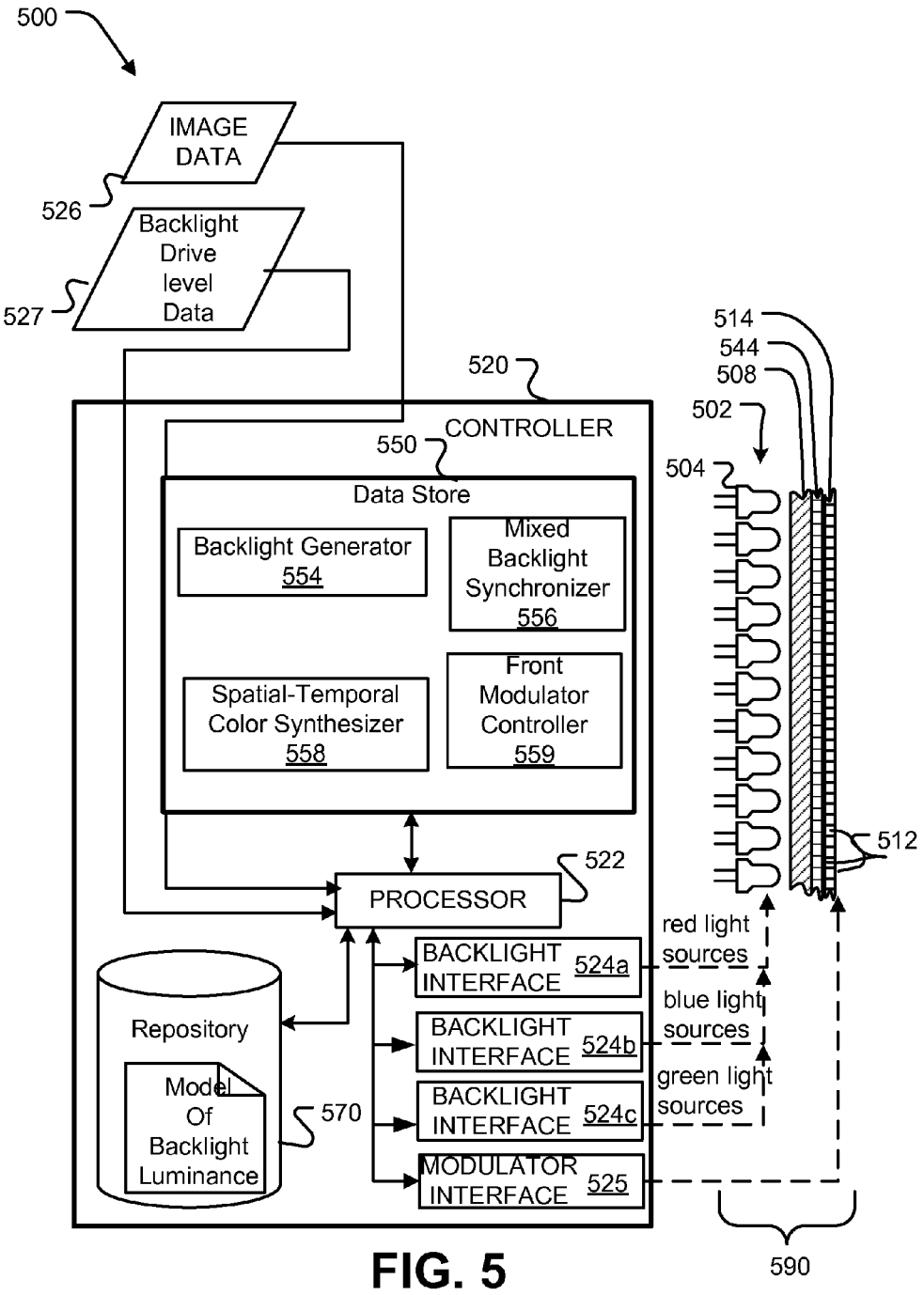
FIG. 5 is a schematic diagram of a controller configured to operate a display device having at least a front modulator, according to at least some embodiments of the invention.

FIG. 5 is a schematic diagram of a controller configured to operate a display device having at least a front modulator, according to at least some embodiments of the invention. System 500 includes a controller 520 configured to be coupled to a display device 590. Controller 520 can include a processor 522, a data store 550, a repository 570, and one or more backlight interfaces ("backlight interface") 524A configured to control a rear modulator, such as a backlight unit and its light sources, and an interface ("modulator interface") 524B configured to control a front modulator. Backlight interfaces 524*a*, 524*b*, and 525*c* are respectively configured to drive modulating elements 504, which can include an array of red light sources, an array of green light sources, and an array of blue light sources. According to at least some embodiments, controller 520 can be implemented in software, hardware, firmware, circuitry, or a combination thereof. Data store 550 can include one or more of the following modules: a backlight generator 554, a mixed backlight synchronizer 556, spatial-temporal color synthesizer 558, and front modulator controller 559, each of which includes executable instructions for performing the functionalities described herein. Repository 570 can be configured to store data structures including data representing a model of backlight luminance, such as data representing predicted luminance patterns for multiple spectral power distributions. According to at least some embodiments, controller 520 can be implemented as hardware modules, such as in programmable logic, including a field-programmable gate array ("FPGA") or equivalent, or as part of an application-specific integrated circuit ("ASIC"). Further, one or more of the following modules can be implemented as firmware: backlight generator 554, a mixed backlight synchronizer 556, spatial-temporal color synthesizer 558, and front modulator controller 559. In some embodiments, repository 570 can be implemented in programmable logic, including an FPGA.

Display device 590 can include a front modulator 514, a rear modulator 502, and optical structures 544 and 508 being configured to carry light from rear modulator 502 to front modulator 514. Front modulator 514 can be an optical filter of programmable transparency that adjusts the transmissivity of the intensity of light incident upon it from rear modulator 502. Rear modulator 502 can be configured to include one or more light sources. In some examples, rear modulator 502 can be formed from one or more modulating elements 504, such as one or more arrays of LEDs. The term rear modulator, as used herein in some embodiments, can refer to backlight, a backlight unit and modulated light sources, such as LEDs. In some examples, the rear modulator can include, but is not limited to a backlight having an array of controllable LEDs or organic LEDs ("OLEDs"). In some examples, front modulator 514 may comprise an LCD panel or other transmission-type light modulator having pixels 512. Front modulator 514 can be associated with a resolution that is higher than the resolution of rear modulator 502. In some embodiments, front modulator 514 may include, but is not limited to an LCD panel, LCD modulator, projection-type display modulators, active matrix LCD ("AMLCD") modulators, and other devices that modulate a light and/or image signal. Optical structures 544 and 508 can include elements such as, but not limited to, open space, light diffusers, collimators, and the like. In some examples, front modulator 514 and rear modulator 502 can be configured to collectively operate display device 590 as an HDR display.

In some embodiments, controller 520 can be configured to provide front modulator drive signals, based upon input image 526 and backlight drive level data 527, to control the modulation of transmissivity associated with LCD pixels 512 of front modulator 514, thereby collectively presenting a desired image on display device 590. Although not shown, controller 520 may be coupled to a suitably programmed computer having software and/or hardware interfaces for controlling rear modulator 502 and front modulator 514 to display an image specified by data corresponding to input image 526. It may be appreciated that any of the elements described in FIG. 5 can be implemented in hardware, software, or a combination of these. In some embodiments, controller 520 can be implemented in projection-based image rendering devices and the like.

Figure 6:
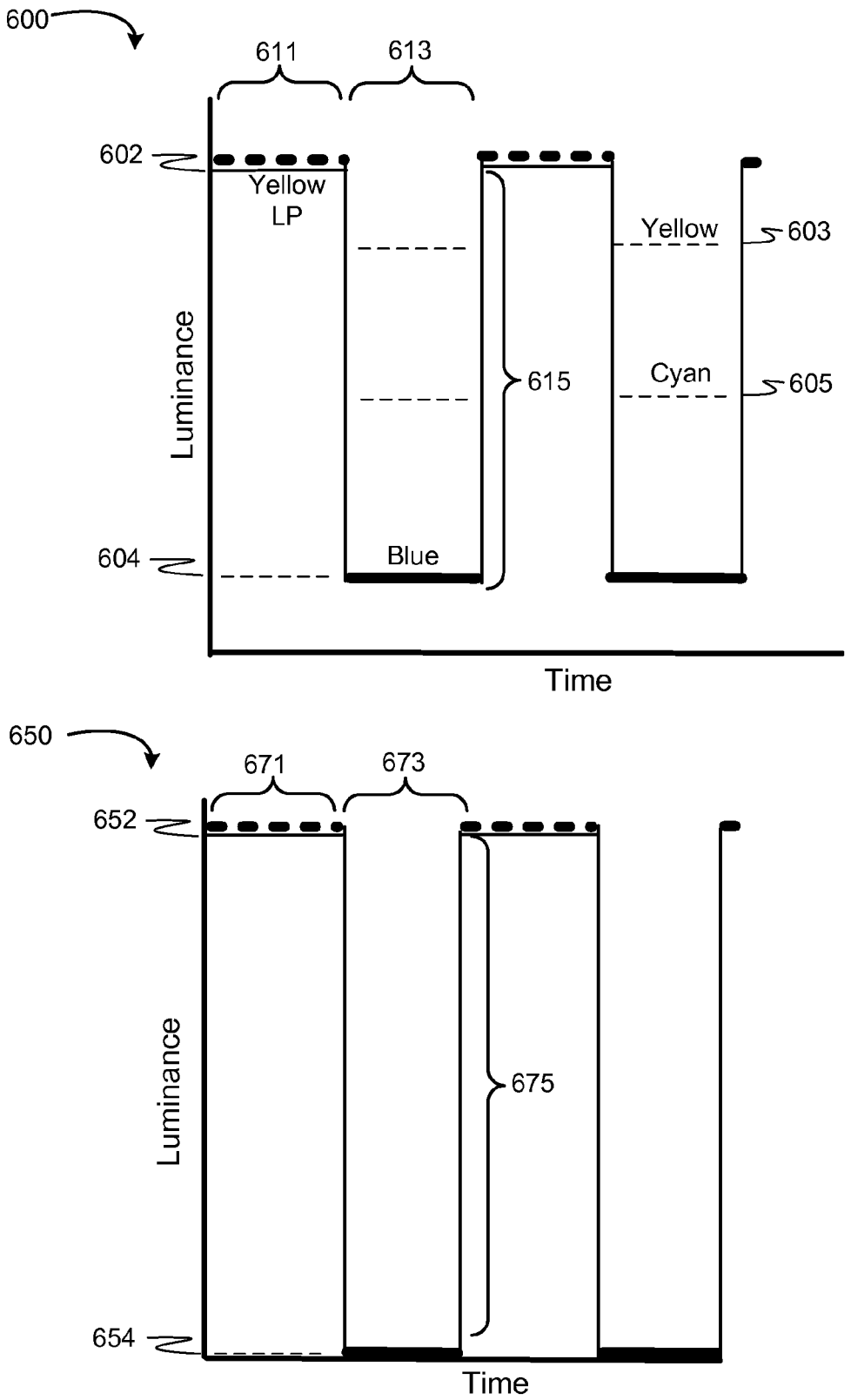
FIG. 6 illustrates a luminance value for a blue luminance pattern that can emulate a black frame insertion, according to at least some embodiments.

FIG. 6 illustrates a luminance value for a blue luminance pattern that can approximate a black frame insertion, according to at least some embodiments. Diagram 600 illustrates the relationship between luminance values and time during which a spectral power distribution for a yellow luminance pattern can provide a luminance value 602 during interval 611, and a spectral power distribution for a blue luminance pattern can provide a luminance value 604. Luminance values 602 and 604 can be generated in combination with cyan and magenta color filter elements in the pixel mosaics. In some embodiments, luminance value 604 can provide a luminance level, such as luminance value 654, to approximate black frame insertion. Thus, luminance value 605 may facilitate reduction of motion blur. Note that diagram 600 depicts a relationship between luminance and time for a specific location (e.g., a group of pixels) on an image. With emulation of a black frame insertion at a localize area of an image, the difference (e.g., between yellow and blue) in luminance can aid in the reduction of flicker by keeping the overall luminance difference relatively low globally (e.g. by interlacing the blue and yellow luminance pattern portions).

Diagram 650 illustrates the relationship between luminance values and time during which a spectral power distribution for a white luminance pattern can provide a luminance value 652 during interval 671, and a spectral power distribution of no intensity can provide a luminance value 654. Note that a luminance difference 615 between luminance values 602 and 604 can be less than a luminance difference 675 between luminance values 652 and 654. In other embodiments, other combinations of spectral power distributions can be used for luminance patterns, such as cyan and yellow. As shown in diagram 600, a cyan-colored luminance pattern can provide a luminance value 605, and a yellow-colored luminance pattern can provide a luminance value 603, where values 605 and 603 can be generated in combination with green and magenta color elements in the pixel mosaics. Note that the luminance difference between values 603 and 605 can be less than luminance difference 615. However, value 605 may be a less effective approximation of value 654 than is value 604, at least in some cases.

Figure 7:
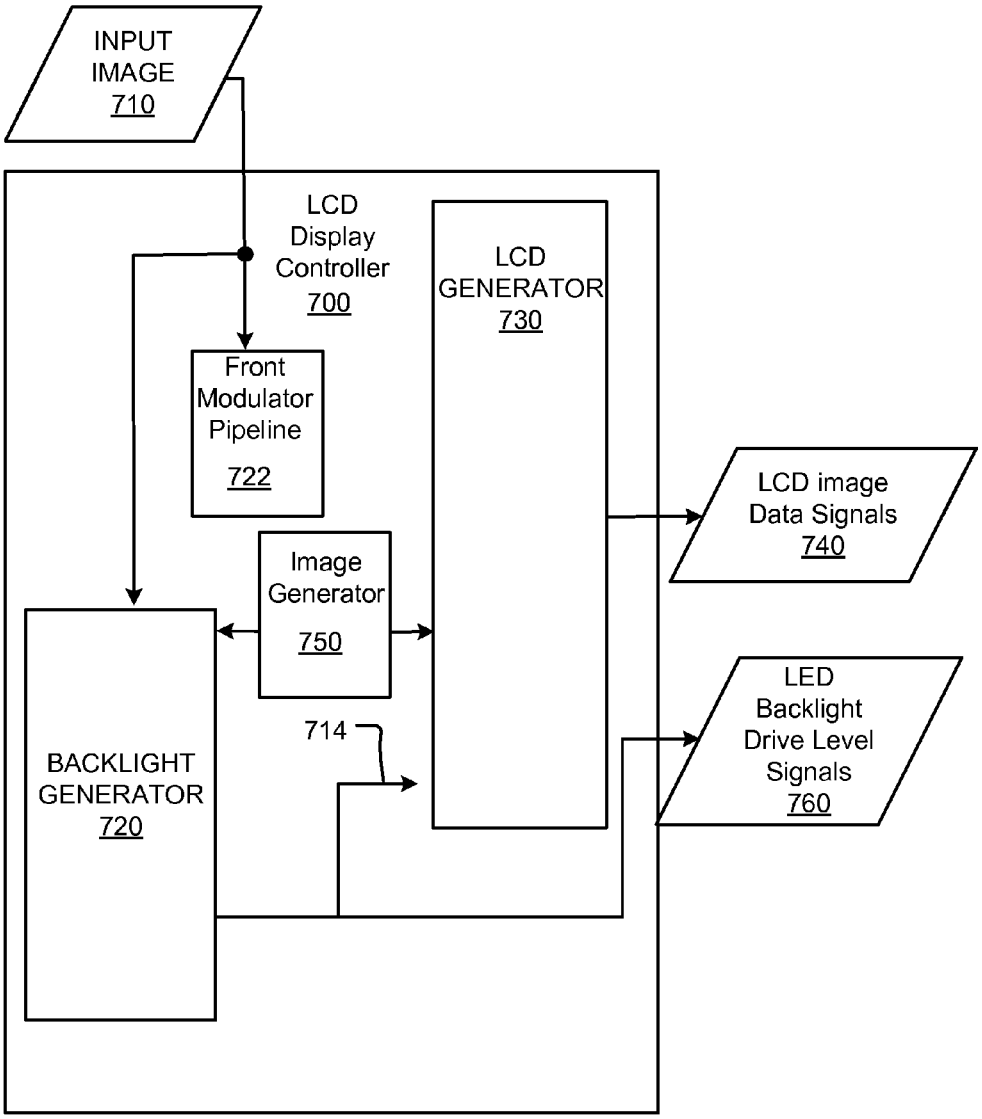
FIG. 7 is a block diagram of an exemplary display controller to operate front and rear modulators, according to at least some embodiments.

FIG. 7 is a block diagram of an exemplary display controller to operate front and rear modulators, according to at least some embodiments. Here, display controller 700 includes a backlight generator 720, front modulator pipeline 722, and LCD generator 730. Backlight generator is configured to generate backlight drive level signals 760 to control the operation of a rear modulator. Input image 710 can be provided as gamma-encoded images to backlight generator 720 and to front modulator pipeline 722. LCD generator 730 and/or backlight generator 720 can be configured to operate with an image generator 750 that can have equivalent structures and/or functionalities as image generator 120 of FIG. 1A. Thus, LCD generator 730 can be configured to generate LCD image data signals 740 to control the operation of a front modulator, based upon input from front modulator pipeline 722, and LED backlight drive level signals 760 provided via path 714. Front modulator pipeline 722 can be configured to generate front modulator output values that produce the desired overall light output and white point. For example, pipeline 722 may apply color correction techniques, such as a dividing operation to divide values by a light simulation output (e.g., a model of backlight) to correct, for example, values representing the gamut and front modulator response. In various embodiments, controller 700 can be an LCD display controller implemented in hardware as circuit board or an integrated chip, or in software as executable instructions or a combination thereof.

FIG. 8 illustrates examples of synthesizing colors based on two sub-pixel color elements and two luminance patterns, according to at least some embodiments of the invention The above-described methods, techniques, processes, apparatuses and computer-medium products and systems may be implemented in a variety of applications, including, but not limited to, HDR displays, displays of portable computers, digital clocks, watches, appliances, electronic devices, audio-visual devices, medical imaging systems, graphic arts, televisions, projection-type devices, and the like.

In some examples, the methods, techniques and processes described herein may be performed and/or executed by executable instructions on computer processors For example, one or more processors in a computer or other display controller may implement the methods describe herein by executing software instructions in a program memory accessible to a processor. Additionally, the methods, techniques and processes described herein may be implemented using a graphics processing unit ("GPU") or a control computer, or FPGA or other integrated circuits coupled to the display. These methods, techniques and processes may also be provided in the form of a program product, which may comprise any medium which carries a set of computer-readable instructions which, when executed by a data processor, cause the data processor to execute such methods, techniques and/or processes. Program products, may include, but are not limited to: physical media such as magnetic data storage media, including floppy diskettes, and hard disk drives; optical data storage media including CD ROMs, and DVDs; electronic data storage media, including ROMs, flash RAM, non-volatile memories, thumb-drives, or the like; and transmission-type media, such as digital or analog communication links, virtual memory, hosted storage over a network or global computer network, and networked-servers.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques, including C, Objective C, C++, C#, Flex™, Fireworks®, Java™, Javascript™, AJAX, COBOL, Fortran, ADA, XML, HTML, DHTML, XHTML, HTTP, XMPP, Ruby on Rails, and others. As hardware and/or firmware, the above-described techniques may be implemented using various types of programming or integrated circuit design languages, including hardware description languages, such as any register transfer language ("RTL") configured to design FPGAs, ASICs, or any other type of integrated circuit. These can be varied and are not limited to the examples or descriptions provided.

Various embodiments or examples of the invention may be implemented in numerous ways, including as a system, a process, an apparatus, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided herein along with accompanying figures. The detailed description is provided in connection with such examples, but is not limited to any particular example. The scope is limited only by the claims, and numerous alternatives, modifications, and equivalents are encompassed. Numerous specific details are set forth in the description in order to provide a thorough understanding. These details are provided as examples and the described techniques may be practiced according to the claims without some or all of the accompanying details. They are not intended to be exhaustive or to limit the invention to the precise forms disclosed, as many alternatives, modifications, equivalents, and variations are possible in view of the above teachings. For clarity, technical material that is known in the technical fields related to the examples has not been described in detail to avoid unnecessarily obscuring the description.

The description, for purposes of explanation, uses specific nomenclature to provide a thorough understanding of the invention. However, it will be apparent that specific details are not required in order to practice the invention. In fact, this description should not be read to limit any feature or aspect of the present invention to any embodiment; rather features and aspects of one example can readily be interchanged with other examples. Notably, not every benefit described herein need be realized by each example of the present invention; rather any specific example may provide one or more of the advantages discussed above. In the claims, elements and/or operations do not imply any particular order of operation, unless explicitly stated in the claims. It is intended that the following claims and their equivalents define the scope of the invention.

What is claimed:

1. A method of generating an image, the method comprising:

receiving input image data;

predicting a first luminance pattern and a second luminance pattern for a first spectral power distribution and a second spectral power distribution, respectively, said first luminance pattern and said second luminance pattern generated from said input image data and comprise a low resolution version of said input image data;

distributing portions of the first luminance pattern and portions of the second luminance pattern in one or more temporal fields;

interlacing the portions of the first luminance pattern and the portions of the second luminance pattern in the one or more temporal fields; and modulating light intensities of the first luminance pattern of the first spectral power distribution and the second luminance pattern of the second spectral power distribution to produce the image with other luminance patterns.

2. The method of claim 1 further comprising:

modulating light intensities of the first luminance pattern and the second luminance pattern to produce other spectral power distributions.

3. The method of claim 1 further comprising:

producing the image, which comprises:

modifying the portions of the first spectral power distribution and the second spectral power distribution to generate respectively a first modified spectral power distribution and a second modified spectral power distribution.

4. The method of claim 3 wherein modifying the portions of the first spectral power distribution and the second spectral power distribution further comprise:

applying the first luminance pattern of the first spectral power distribution to a first group of color elements; and applying the second luminance pattern of the second spectral power distribution to a second group of color elements substantially coincident to applying the first luminance pattern to the first group of color elements.

5. The method of claim 1 wherein modulating light intensities of the first luminance pattern and the second luminance pattern comprises:

scaling luminance values of the first luminance pattern and the second luminance pattern.

6. The method of claim 1 further comprising:

synchronizing distribution of the portions of the first luminance pattern and the portions of the second luminance pattern to generation of a first modified spectral power distribution and a second modified spectral power distribution.

7. The method of claim 1 wherein modulating light intensities of the first luminance pattern of the first spectral power distribution and the second luminance pattern of the second spectral power distribution comprise:

activating groups of modulating elements to modify luminance values of the first luminance pattern and the second luminance pattern, wherein activating the groups of modulating elements is during an interval of time.

8. The method of claim 7 wherein activating groups of modulating elements comprises:

activating successive groups in the groups of modulating elements; and alternating modulation of the light of the first luminance pattern and modulation of the light of the second luminance pattern, wherein the rate at which the first luminance pattern and the second luminance pattern alternate is substantially the same as the rate at which the successive groups are activated.

9. The method of claim 1 wherein distributing portions of the first luminance pattern and portions of the second luminance pattern comprises:

transitioning from one portion of the first luminance pattern in a first temporal field to one portion of the second luminance pattern in the first temporal field.

10. The method of claim 9 further comprising:

selecting a group of color elements to interact with the second luminance pattern; and synchronizing the transition from the one portion of the first luminance pattern to the one portion of the second luminance pattern to the selection of the group of color elements, wherein an optical path passes through the one portion of the second luminance pattern and the group of color elements.

11. The method of claim 1 wherein modulating light intensities of the first luminance pattern of the first spectral power distribution and the second luminance pattern of the second spectral power distribution comprise:

driving a first group of modulating elements at a first set of drive levels; and driving a second group of modulating elements during the same temporal field as driving the first group of modulating elements, the second group of modulating elements being driven at a second set of drive levels, wherein the first set of drive levels and the second set of drive levels are based on different luminance pattern.

12. The method of claim 1 wherein distributing portions of the first luminance pattern and portions of the second luminance pattern comprise:

activating groups of light sources to alternately produce the portions of the first luminance pattern and the portions of the second luminance pattern in each of the one or more temporal fields.

13. The method of claim 12 further comprising:

activating the groups of light sources in sequence during one temporal field of the one or more temporal fields.

14. The method of claim 1 wherein distributing the portions of the first luminance pattern and the portions of the second luminance pattern comprises:

interlacing a first subset of the portion of the first luminance pattern and a first subset of the portions of the second luminance pattern to form a first arrangement of mixed portions in a first temporal field; and interlacing a second subset of the portion of the first luminance pattern and a second subset of the portions of the second luminance pattern to form a second arrangement of mixed portions in a second temporal field, wherein the first arrangement of mixed portions and the second arrangement of mixed portions overlap in a frame that includes the first temporal field and the second temporal field.

15. The method of claim 1 wherein distributing portions of the first luminance pattern and portions of the second luminance pattern comprise:

activating a first set of light sources to generate the first luminance pattern; and activating a second set of light sources to generate the second luminance pattern.

16. The method of claim 15 further comprising:

approximating insertion of a black frame.

17. The method of claim 16 wherein approximating the insertion of the black frame further comprises:

using blue light sources and yellow light sources.

18. The method of claim 1 further comprising:

selecting color elements to filter wavelengths of light of the first luminance pattern and filter wavelengths of light of the second luminance pattern in the same temporal field to produce other spectral power distributions.

19. An apparatus for generating images comprising:

a back modulator comprising sets of light sources, each set of light sources being configured to generate a luminance pattern having a spectral power distribution;

a front modulator comprising:

an array of modulating elements, an array of color elements;

an image generator coupled to the back modulator and the front modulator, the image generator configured to receive input image data and generate interlaced portions of luminance patterns and to activate groups of the modulating elements, wherein the interlaced portions of luminance patterns are generated from said input image data and comprise a low resolution version of said input image data; and a mixed backlight synchronizer configured to control modulation of the sets of light sources to generate the portions of the luminance patterns that are interlaced with each other, wherein the portions of the luminance patterns are generated sequentially, each of the portions of the luminance patterns being generated in synchronicity with the interval of time.

20. The apparatus of claim 19 wherein at least one of the interlaced portions of the luminance patterns is generated substantially concurrent with the activation of a group of the modulating elements.

21. The apparatus of claim 19 further comprising:

a back modulator controller configured to generate models of backlight associated with different spectral power distributions, and further configured to partition the models of backlight into portions.

22. The apparatus of claim 19 further comprising:

a front modulator controller configured to activate successive groups in the groups of modulating elements, each of the successive groups being activated during an interval of time.

23. The apparatus of claim 22 wherein the mixed backlight synchronizer is further configured to temporally overlap a first set of interlaced portions during one temporal field with a second set of interlaced portions during another temporal field.

24. The apparatus of claim 22 wherein the front modulator controller is configured to generate drive signals in each temporal field that are based on multiple luminance patterns.

* * * * *